US006586892B2

(12) United States Patent
Derra et al.

(10) Patent No.: US 6,586,892 B2
(45) Date of Patent: Jul. 1, 2003

(54) METHOD OF AND DEVICE FOR OPERATING A GAS DISCHARGE LAMP

(75) Inventors: Günther Hans Derra, Aachen (DE); Hanns Ernst Fischer, Stolberg (DE); Thomas Krücken, Aachen (DE); Holger Moench, Vaals (DE); Xaver Riederer, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/840,813

(22) Filed: Apr. 24, 2001

(65) Prior Publication Data

US 2002/0011803 A1 Jan. 31, 2002

(51) Int. Cl.[7] ..... G05F 1/00; H05B 41/16
(52) U.S. Cl. ..... 315/291; 315/224
(58) Field of Search ..... 315/209 R, 224, 315/225, 291, DIG. 2, DIG. 5

(56) References Cited

U.S. PATENT DOCUMENTS

| | | | | |
|---|---|---|---|---|
| 5,235,254 A | | 8/1993 | Ho | 315/219 |
| 5,363,020 A | | 11/1994 | Chen et al. | 315/209 |
| 5,428,408 A | | 6/1995 | Stanton | 348/742 |
| 5,608,294 A | * | 3/1997 | Derra et al. | 315/224 |
| 5,841,246 A | * | 11/1998 | Manders | 315/307 |
| 5,959,411 A | * | 9/1999 | Veldman | 315/224 |
| 6,127,789 A | * | 10/2000 | Ishizuka et al. | 315/308 |
| 6,172,468 B1 | * | 1/2001 | Hollander | 315/291 |
| 6,191,537 B1 | * | 2/2001 | Celso | 315/219 |
| 6,208,089 B1 | * | 3/2001 | Ito et al. | 315/308 |
| 6,215,252 B1 | * | 4/2001 | Stanton | 315/224 |
| 6,218,789 B1 | * | 4/2001 | Takahashi et al. | 315/246 |
| 6,239,556 B1 | * | 5/2001 | Derra et al. | 315/209 R |
| 6,278,244 B1 | * | 8/2001 | Hevinga et al. | 315/291 |
| 6,445,141 B1 | * | 9/2002 | Kastner et al. | 315/307 |

FOREIGN PATENT DOCUMENTS

| | | | |
|---|---|---|---|
| EP | 0865210 A3 | 9/1998 | H04N/9/31 |
| EP | 0865210 A2 | 9/1998 | H04N/9/31 |

* cited by examiner

*Primary Examiner*—Don Wong
*Assistant Examiner*—Minh D A
(74) *Attorney, Agent, or Firm*—Ernestine C. Bartlett

(57) ABSTRACT

A method of and a device for operating a gas discharge lamp which is fed with an alternating voltage or an alternating current and wherein the instantaneous power of the lamp is increased at given time intervals are used to form the electrodes. The value of an operational datum of the lamp which varies in time is continuously or discontinuously measured and the frequency of the alternating voltage or the alternating current (operating frequency) is selected in dependence on the measured values.

19 Claims, 3 Drawing Sheets

METHOD OF AND DEVICE FOR OPERATING A GAS DISCHARGE LAMP

BACKGROUND OF THE INVENTION (1) Field of the Invention

The invention relates to a method of and a device for operating a gas discharge lamp which is fed with an alternating voltage or an alternating current, the instantaneous power of the lamp being increased (pulsed mode of operation) at given time intervals. The invention also relates to apparatus equipped with such lamps and devices as well as to methods of treating an electrode which are based on said mode of operation.

(2) Description of Related Art including information disclosed under 37 CFR 1.97 and 1.98

Such modes of operation and devices are known, for example, from WO 96/174724 or from U.S. Pat. No. 5,608,294. The cited WO publication discloses a device with an energy supply circuit for operating a gas discharge lamp wherein the energy supply circuit provides an alternating voltage or an alternating current of predetermined period duration in order to feed the gas discharge lamp with a predetermined power in such a manner that, when the mean lamp power is reduced relative to the nominal power, the instantaneous power is increased within one half period duration directly prior to the pole reversal of the alternating voltage or the alternating current. This brief increase of the instantaneous power prior to the pole reversal ensures that the re-ignition voltage required after the pole reversal essentially need not be increased relative to the voltage in the nominal mode of operation.

The cited United States patent describes a method of operating a gas discharge lamp with a short light arc; therein, the lamp receives an alternating current of a given period duration and a brief current pulse is superposed on the lamp current in each half period, which current pulse has the same polarity as the lamp current in the relevant half period so that the constancy of the light arc and the durability of the electrodes of the gas discharge lamp are essentially improved.

The variation of the current intensity or the voltage, as known from the cited publications and referred to hereinafter as "pulsed operation" or "pulsed mode", has proven to be very effective in practice. It is to be noted that in this context the terms "pulsed operation" and "pulsed mode" are to be understood to cover all variations of the current strength or voltage in time where additional current or voltage pulses are superposed on the operating current or the operating voltage, notably for the purpose of stabilization of the lamp arc (in many publications (for example, see EP 0 865 210 A2, WO 97/247871 or U.S. Pat. No. 5,428,408), however, the term "pulsed operation" is to be understood to mean exclusively a lamp mode of operation in which the lamp operates in quickly repeated, very short periods of time and does not output light during a large part of the time).

Although pulsed operation can considerably improve the constancy of the light arc, the service life is not yet satisfactory; this is important notably in the case of high-pressure gas discharge lamps with a very short light arc, such as used, for example in data and video projectors with LC or mirror displays (deformable mirror device), but also for various other applications. The shorter the light arc required, the more severe the effects of burning off of the lamp electrodes and the accompanying extension of the light arc between the electrodes will be. It is not seldom that burning off of the lamp electrodes in gas discharge lamps with short and very short light arcs during the first 100 hours of operation already reduces the efficiency in, for example, a projection system, by 20%.

Moreover, the manufacture of gas discharge lamps with a very short electrode gap is extremely difficult, since the electrodes are normally sealed in a quartz tube and are positioned, prior to the sealing into the tube, in such a manner that, due to the manufacturing process, their position deviates from the original setting after the finishing of the lamp, that is, both in respect of the gap as well as in respect of the lateral alignment with one another. The positioning tolerances of the electrodes can be reduced at great expense only.

A further problem that can be solved with great difficulty only is posed by the geometrical shape of the electrodes themselves. Granted, it is possible to cut desired electrode geometries from a solid material, but for reasons of cost that the electrodes preferably consist of an electrode rod (drawn tungsten wire) with a tungsten spiral slid thereon, even though the geometry and the inner structure of the electrodes, ultimately defining the heat distribution, can be controlled to a lesser extent in such a construction. In lamps having a short light arc the enormous thermal loading of the electrodes already causes fast transport of the electrode material (for example, evaporation of tungsten) which, within a few hours, can completely change the electrode front face in high-pressure gas discharge lamps having an arc length of approximately 1 mm. Even an ideally shaped electrode will usually retain its original functional properties for only less than 100 hours in such circumstances.

BRIEF SUMMARY OF THE INVENTION

Considering the foregoing, it is an object of the invention to provide a method and a device for operating a gas discharge lamp which make it possible to use the transport processes taking place during operation of a gas discharge lamp advantageously for the formation of the electrodes.

The object is achieved by a method in which processes inherent in gas discharge lamps improve formation of the electrodes. In particular, the lamp can be operated in a mode which produces useful light, while at the same time the lamp electrodes are rejuvenated by growth of structures on the electrode tips which compensate for bum-off of electrode material and reduce the arc length to the desired value. The magnitude of the structures which grow on the electrodes is proportional to the operating frequency, while the diameter is smaller as operating frequency is raised.

The object is achieved notably by means of a method of the kind set forth wherein the values of at least one operational datum of the lamp which varies in time are continuously or discontinuously measured and the frequency of the alternating voltage or the alternating current (operating frequency) is selected in dependence on the measured values. The operating frequency is then advantageously selected in dependence on the measured values of at least one operational datum from the group of operational data which includes the overall service life of the lamp, the operating voltage, the power taken up or given off, the arc length and the electrode gap, since all such data offer direct or indirect information concerning the state of the electrodes, notably the electrode gap (for example, even in the case of a new lamp having a service life, an idea of the approximate state of the electrodes, and hence of the necessity of selecting a given operating frequency, can be derived from the service life itself on the basis of experimental values).

Those of ordinary skill will recognize that, as used herein, operating frequency refers to a frequency used after starting power for ignition and lamp warm-up have been provided at start-up frequencies, and that increasing the power of the lamp at a succession of given time intervals is a repeated action different from any changing of the lamp power which occurs during warm-up. Also, starting frequency, at the beginning of an electrode regeneration operation, is not related to start-up frequencies used during ignition and warm-up.

The invention is based on the novel insight that the magnitude of the structures growing on the electrodes during operation with alternating current or alternating voltage is proportional to the operating frequency of the current or the voltage. It has been found that the diameter of the structures grown is smaller as the fundamental frequency of the operating current or the operating voltage is higher. Typical frequencies in high-pressure gas discharge lamps lie between approximately 40 and 600 Hz. For lamps of a given type (for example, in conformity with DE 38 13 421 A), for example, the following relation holds: approximate diameter of the structures grown=a/f1/2, where f is the operating frequency in Hertz and a is a lamp-specific proportionality constant which lies typically between approximately 2000 and 5000 pm Hz1/2, so that structures having a diameter of from approximately 200 to 500 $\mu$m are formed in the case of a fundamental frequency of 100 Hz. Generally speaking, this constant may lie in a slot between 1000 and 10,000 $\mu$m Hz1/2. The height of the structures formed generally is smaller than their diameter and as a rule amounts to approximately from 0.4 to 0.8 times the diameter. The ratio, however, has been found to vary between 0.2 and 1.2. This relationship is used according to the invention so as to form projecting electrode tips in a controllable manner during operation of the lamp.

The invention enables formation of the electrode during operation, independently (within given limits) of the basic shape of the electrodes as imposed by the manufacturing process. The desired electrode gap, or the desired operating voltage, can be adjusted within given limits by utilizing the transport processes. When the desired voltage is reached, the conditioning process is interrupted and the lamp is operated at the frequency prevailing at that instant.

It is a special advantage of the method according to the invention that it can be applied time and again during the service life of the lamp, thus allowing to some extent a "regeneration" of the electrodes so that outstanding results can be achieved over a very long service life.

Because of the physical laws of the transport processes, the electrode structures formed during operation are situated practically exactly opposite one another, so that no lateral offset occurs. When the operation commences with sufficiently low frequencies, the structure will be situated at the electrode center.

To this end, the measured values are advantageously monitored in respect of the satisfying of predetermined secondary conditions and when a first secondary condition is satisfied (start condition), the lamp is operated with a low operating frequency (starting frequency) until a second secondary condition is satisfied, after which the operating frequency is increased. Such start conditions may be, for example, the putting into operation of a new lamp for the first time or the building up of the necessary operating voltage beyond a given limit value. It is notably also possible to define different start conditions with different starting frequencies so that, for example, successive structures of decreasing diameter can be built up on the electrodes when a new lamp is put into operation for the first time, a start being made with a comparatively low starting frequency, whereas in the case of electrodes whose shape is to be modified only slightly it may suffice to build up small structures immediately and to start with a comparatively high starting frequency.

The operating frequency can be continuously increased for successively building up the structures. However, it has been found that it is particularly advantageous to increase the operating frequency in discrete steps until a predetermined interruption condition is reached. Such interruption conditions may be: the reaching of a predetermined operating frequency (maximum frequency), the reaching of a predetermined minimum operating voltage, constancy of the electrode gap over a predetermined period of time.

A device which is arranged to achieve the described object in operating a gas discharge lamp is provided with measuring means for the continuous or discontinuous measurement of the values of at least one operational datum of the lamp which varies in time and with means for changing the frequency of the alternating voltage or the alternating current (operating frequency) in dependence on the measured values. Such a device can also be simply used for or be provided in already manufactured gas discharge lamps and lighting devices used for gas discharge lamps of all types, notably projectors, lighting systems of trucks etc.

A preferred embodiment of the device includes a compact evaluation and control unit which includes at least one microprocessor and is intended to control the operating frequency, the operating voltage and the alternating current applied to the gas discharge lamp, as well as to evaluate and monitor the measured values in respect of the satisfying of predetermined or selectable secondary conditions; advantageous use can then be made of processors and units already provided in existing devices for the pulsed operation of gas discharge lamps.

Figure 1:
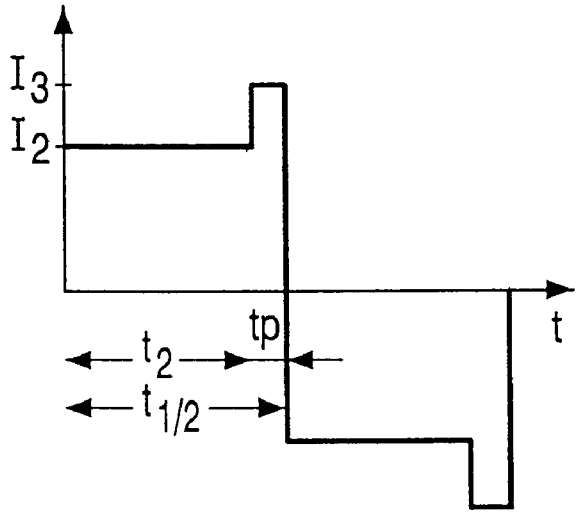
FIG. 1 shows a typical variation in time of the operating current applied to a gas discharge lamp during pulsed operation.

The cited U.S. Pat No. 5,608,294 describes an electronic ballast device which is capable of generating a current form as shown in FIG. 1 with an additional current pulse of the height I3 and the duration tp at the end of the relevant half-wave of overall duration t1/2 and the basic height I2. Preferably, this is realized by means of a microprocessor-controlled ballast device which is also capable of controlling the lamp operating frequency. It may also include a data carrier which contains a control program for executing the steps to be described hereinafter. There may also be provided a reading device whereby a machine-readable data carrier can be read so as to transfer its data to the ballast device.

Figure 2:
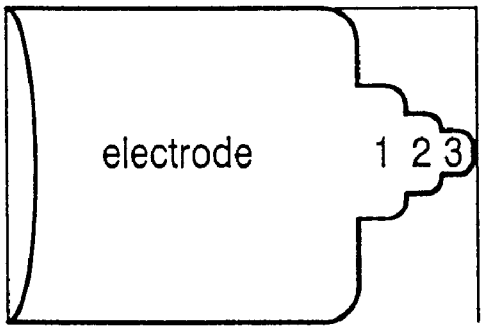
FIG. 2 shows diagrammatically the lateral profile of an electrode formed by the method according to the invention.
Figure 3:
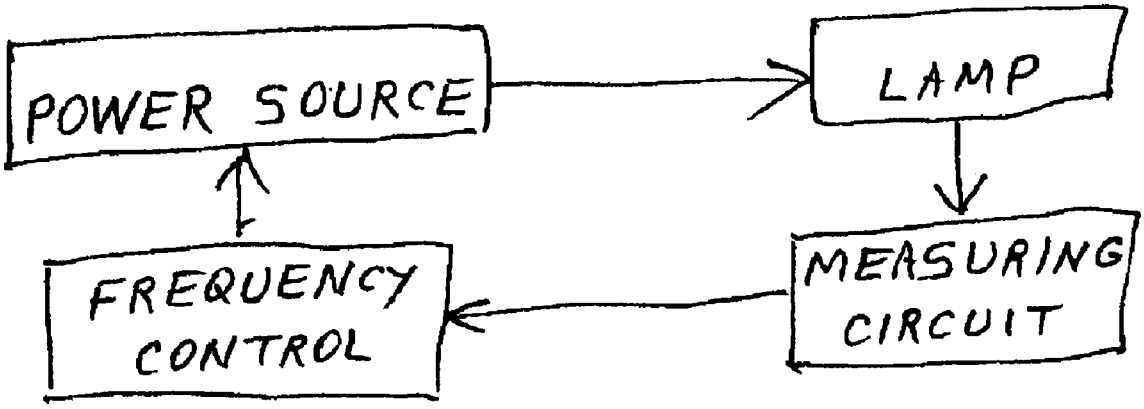
FIG. 3 shows diagrammatically a device for operating the lamp of FIG. 1 according to the invention.

In order to build up an electrode having the desired shape as shown in profile in FIG. 2, the lamp is operated with a slowly increasing frequency, starting from a low starting frequency, in the pulsed mode. A low frequency at the beginning of the sequence provides a wide structure 1, having a cross section less than the front face of the electrode, and forming a projecting electrode tip, as a base on which continuously narrower structures 2 and 3 can be built at higher frequencies. The transition may be continuous or take place in discrete steps. Practical results were obtained, for example, with an operation duration of each time a few hours at 45, 65, 90 and 130 Hz in this increasing sequence. Using this mode of operation it was found to be possible to reduce the electrode gap in a conventional high-pressure gas discharge lamp from 1.3 mm to 0.7 mm. During prolonged operation (some hundreds of hours) of the lamp thus conditioned at the highest frequency, the electrodes then gradually burn off to the initial state again, as can be readily observed on the basis of an increase of the operating voltage.

Figure 4:
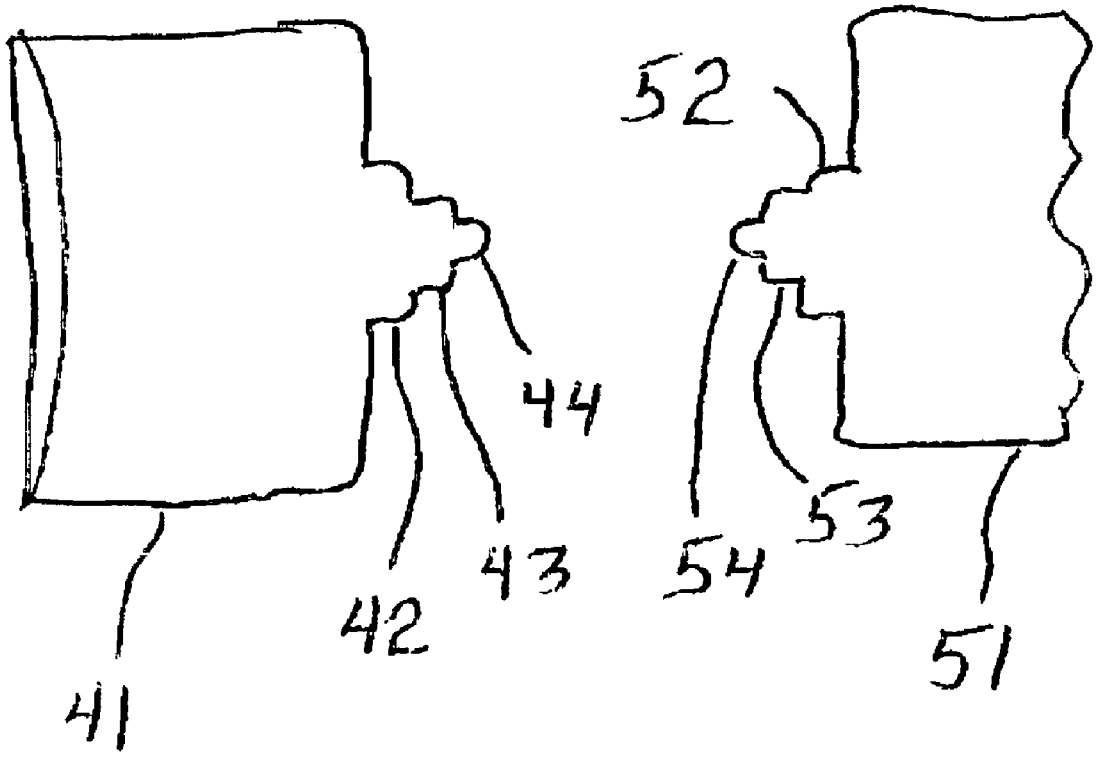
FIG. 4 shows diagrammatically opposed electrode tips of a short-arc lamp.

FIG. 4 shows diagrammatically the opposed electrodes 41 and 51 of a short arc lamp on which projecting electrode tips 42, 43, 44 and 52, 53, 54 have been grown opposite each other, situated at the electrode centers.

When the operating voltage increases, the electrode according to the invention can be treated again with slowly increasing frequencies until the tip structures of the electrode have been almost completely rebuilt again. After every regeneration operation of this kind, the lamp can be operated at the highest selected frequency again for approximately 100 hours.

The invention offers the major advantage that the light of the lamp can also be used during the regeneration phases. Overall, the optical efficiency usually decreases as the electrode gap increases (for example, a decrease of the screen brightness in the case of video projection; this brightness is increased by the regeneration). Such a system efficiency, fluctuating over a time scale of 100 hours, in any case constitutes a major advantage which outweighs a continuously decreasing efficiency.

The necessity of renewed regeneration can be readily deduced from the voltage rise of the lamp. When the operating voltage increases beyond a predetermined value, renewed regeneration is started.

DETAILED DESCRIPTION OF THE INVENTION

Hereinafter it will be described in detail, by way of example, how the method according to the invention can be carried out during operation of a gas discharge lamp of a video projector.

First-time operation of the lamp is recognized by way of an hours of operation counter which is automatically reset when a lamp is replaced. This is already implemented in many commercially available projectors.

The lamp is initially operated at an as low as possible frequency (for example, 45 Hz. Such operation can take place during a fixed time interval (for example, one hour of operation). Alternatively, the frequency can also be sustained until a significant voltage decrease (indicating growth of structures) can no longer be observed. This mode of operation is advantageous in that individual differences can be taken into account better than in the case of operation during fixed periods of time.

Subsequently, the frequency is increased. It has been found that an increase of the frequency to approximately from 1.2 to 1.8 times the respective preceding frequency is advisable. The operation at the new frequency can again take place for a fixed period of time or until a significant voltage decrease can no longer be detected.

Overall, the frequency is increased until either a) a fixed frequency limit is reached, b) a fixed voltage is reached or c) a significant growth can no longer be observed after an increase of the frequency.

The frequency thus determined is sustained and can be used, for example, until the voltage has considerably increased again, for example to the initial level. Preferably, however, the electrodes are "regenerated" anew before the rise to the initial level already; for this purpose the lamp is operated again at an as low as possible frequency.

The method according to the invention enables a substantial reduction of the operating voltage and the arc length or the electrode gap in gas discharge lamps. For example, in a gas discharge lamp of conventional construction, having electrodes of the previously described simple and economical construction, the operating voltage could be reduced from initially 85 V to 52 V and the arc length from initially 1.3 mm to 0.7 mm in the presence of a lamp current I2 for controlling the power and a pulse current I3 amounting to 2.8 A while utilizing a sequence of operating frequencies of 45, 65, 90 and 130 Hz; it is to be noted that this amazing reduction was not achieved in a separate process but during "normal" use of the lamp, for example, in the projection mode.

Many alternative versions and further elaborations are feasible within the scope of the invention; such alternatives relate, for example, to the secondary conditions at which the operating frequencies are increased or decreased, or to the selection of the operating frequencies. It is an essential aspect that the method enables treatment of the electrodes during operation of the gas discharge lamp in that transport phenomena are used to deposit material on the electrodes by controlled variation of the operating frequency.

What is claimed is:

1. A method of operating a gas discharge lamp which is fed with an alternating electric power source, wherein the lamp has electrodes having respective electrode front faces, and the lamp has operational characteristics after lamp starting which vary in time over periods which are a multiplicity of cycles of said electric power source, comprising:

providing lamp starting power at start-up frequencies, and after lamp start-up providing operating power at operating frequencies, and after start-up, increasing the instantaneous power of the lamp to a value greater than the mean lamp power during each of a succession of given time intervals shorter than said periods, characterized in that the method further comprises:

measuring the values of at least one operational datum representative of at least one of said operational characteristics, and responsive to the measured values, causing growth of structures on said electrodes having respective cross sections less than the respective electrode front faces, and respectively forming projecting electrode tips, by selecting the operating frequency of the alternating electric power source.

2. The method of claim 1, characterized in that the selecting step comprises selecting a low starting frequency to cause said growth of structures, and then increasing the frequency to a first frequency higher than the low starting frequency to cause further growth of structures.

3. The method of claim 1, wherein the step of increasing the instantaneous power of the lamp consists of operating the lamp in a pulsed mode, further comprising operating the lamp at a selected frequency after the step of causing growth of structures, while continuing the measuring step, and responsive to a given operational datum reaching a predetermined value, repeating the step of causing growth of structures.

4. The method of claim 3, wherein said given time intervals each occur directly prior to polarity reversal of the alternating voltage or current.

5. The method of claim 3, characterized in that the selecting step comprises selecting a low starting frequency to cause said growth of structures, and then increasing the frequency to a first frequency higher than the low starting frequency to cause further growth of structures.

6. The method of claim 5, characterized in that the at least one operational datum is arc voltage, the frequency is increased in a discrete step, and the first frequency is sustained at least until voltage decrease can no longer be observed.

7. The method as claimed in claim 5 wherein the operating frequency is increased in discrete steps, characterized in that the frequency is incremented each time between approximately 1.2 and 1.8 times.

8. The method of claim 5, wherein the lamp is a short light arc lamp having an arc length of approximately 1 mm, the electrode front faces face each other, and the projecting electrode tips project toward each other.

9. The method of claim 8, wherein the electrode gap is maintained within the range of approximately 1.3 mm to 0.7 mm.

10. The method of claim 1, characterized in that the selecting step starts a regeneration operation which comprises decreasing the frequency to a starting frequency, to cause growth of structure having respective first cross sections less than the respective front face cross sections, then increasing the frequency to cause growth of structures having at least a second cross section less than the respective first cross section until a predetermined interruption condition is reached, the frequency then being a highest frequency for that renewing operation, then maintaining said highest frequency until a first operational datum is measured, and then repeating the selecting step to start another regeneration operation.

11. The method as claimed in claim 10 wherein the operating frequency is increased in discrete steps, characterized in that the frequency is incremented each time between approximately 1.2 and 1.8 times, the at least one operational datum is arc voltage, and each increased frequency is sustained until voltage decrease can no longer be observed.

12. A method of treating the electrodes of a gas discharge lamp which is fed with an alternating electric power source, wherein the lamp has electrodes having respective electrode front faces, and the lamp has operational characteristics after lamp starting which vary in time over periods which are a multiplicity of cycles of said electric power source, comprising:

providing lamp starting power at start-up frequencies, and after lamp start-up providing operating power at operating frequencies, and after start-up, increasing the instantaneous power of the lamp to a value greater than the mean lamp power during each of a succession of given time intervals shorter than said periods, characterized in that the method further comprises changing the frequency of the alternating electric power for deliberate use of the transport of electrode material occurring during operation of the lamp to cause growth of structures on said electrodes, said structures having respective cross sections less than the respective electrode front faces, and respectively forming projecting electrode tips.

13. The method of claim 12, further comprising operating the lamp at a selected frequency after the step of changing frequency growth of structures, measuring the values of at least one operational datum representative of at least one of said operational characteristics, and responsive to a given operational datum reaching a predetermined value, repeating the step of changing the frequency of the alternating electric power for deliberate use of the transport of electrode material.

14. The method of claim 13, further comprising selecting a low starting frequency to cause said growth of structures, and then increasing the frequency to a first frequency higher than the low starting frequency to cause further growth of structures.

15. A device for operating a gas discharge lamp which is fed with an alternating electric power source, the lamp having electrodes having respective electrode front faces, the lamp having operational characteristics which vary in time over periods which are a multiplicity of cycles of said electric power source, and the device comprising means for providing starting power at start-up frequencies and providing operating power after start-up at operating frequencies, wherein after start-up and while the lamp is receiving operating power at operating frequencies the instantaneous power of the lamp is increased at given time intervals, characterized in that the device further comprises:

means for measuring the values of at least one operational datum representative of at least one of said operational characteristics, and means, responsive to the measured values, for causing growth of structures on said electrodes having respective cross sections less than the respective electrode front faces, and respectively forming projecting electrode tips, by selecting the operating frequency of the alternating electric power source.

16. The device of claim 15, characterized in that the means for causing growth selects a low starting frequency to cause said growth of structures, and then increases the frequency to a first frequency higher than the low starting frequency to cause further growth of structures.

17. The device of claim 15, wherein the increase of the instantaneous power of the lamp operates the lamp in a pulsed mode, further comprising means for operating the lamp at a selected frequency after the growth of structures, and continuing to measure values, and responsive to a given operational datum reaching a predetermined value, said means for causing growth of structures again selects an operating frequency to cause additional growth of structures selecting step comprises selecting a low starting frequency to cause said growth of structures, and then increasing the frequency to a first frequency higher than the low starting frequency to cause further growth of structures.

18. The method of claim 17, characterized in that the at least one operational datum is arc voltage, the frequency is increased in a discrete step, and the first frequency is sustained at least until voltage decrease can no longer be observed.

19. The method as claimed in claim 17 wherein the operating frequency is increased in discrete steps, characterized in that the frequency is incremented each time between approximately 1.2 and 1.8 times.

* * * * *